US012624625B2

(12) United States Patent
Marshall

(10) Patent No.: US 12,624,625 B2
(45) Date of Patent: May 12, 2026

(54) DOWN HOLE DESANDER

(71) Applicant: Modicum LLC, Gardendale, TX (US)

(72) Inventor: Gary V. Marshall, Gardendale, TX (US)

(73) Assignee: Modicum LLC, Gardendale, TX (US)

( * ) Notice: Subject to any disclaimer, the term of this patent is extended or adjusted under 35 U.S.C. 154(b) by 0 days.

(21) Appl. No.: 18/901,754

(22) Filed: Sep. 30, 2024

(65) Prior Publication Data

US 2025/0264011 A1 Aug. 21, 2025

Related U.S. Application Data

(63) Continuation of application No. 17/750,314, filed on May 21, 2022, now Pat. No. 12,104,479.

(60) Provisional application No. 63/320,082, filed on Mar. 15, 2022, provisional application No. 63/208,360, filed on Jun. 8, 2021.

(51) Int. Cl.
*E21B 43/34* (2006.01)
*E21B 43/38* (2006.01)

(52) U.S. Cl.
CPC ..... *E21B 43/35* (2020.05); *E21B 43/38* (2013.01)

(58) Field of Classification Search
CPC ..... E21B 43/38; E21B 43/35; E21B 43/121; E21B 17/00
See application file for complete search history.

(56) References Cited

U.S. PATENT DOCUMENTS 5,662,167 A * 9/1997 Patterson ..... B01D 21/0003 166/105.1
2016/0333681 A1* 11/2016 Mazzanti ..... E21B 43/38
2019/0085677 A1* 3/2019 Marshall ..... E21B 43/35

* cited by examiner

*Primary Examiner* — Zakiya W Bates
(74) *Attorney, Agent, or Firm* — Ray Quinney & Nebeker P.C.; Paul N. Taylor

(57) ABSTRACT

A downhole solids separator having: a plurality of solids separation modules, a production tube disposed therein, one or more limited entry ports in the production tube, placed in each of the modules, an intake port in the lower half of each module opening into a wellbore annulus, the intake port below the limited entry port of the module, a closed chamber for collecting solids, isolated from the well bore, the closed chamber below modules, a solids conveying conduit from at least one module, opening into the closed chamber, an opening restricted to less than the size of the production tube in the conduit near the bottom of the module, an opening in the production tube in the closed chamber, where the production tube opening and conduit opening are configured to effect a drop fluid velocity into production tube to a level insufficient to carry solids into the production tube.

8 Claims, 5 Drawing Sheets

DOWN HOLE DESANDER

CROSS REFERENCE TO RELATED APPLICATIONS

This application is a continuation of U.S. patent application Ser. No. 17/750,314, filed May 21, 2022, which claims priority from U.S. Provisional Patent Application Ser. No. 63/208,360, filed Jun. 8, 2021 and U.S. patent application Ser. No. 17/750,314 claims priority from U.S. Provisional Patent Application Ser. No. 63/320,082, filed Mar. 15, 2022, the entire contents of all of which are hereby incorporated by reference.

TECHNICAL FIELD

Disclosed herein are improvements to down-hole solids separation methods, apparatus, and systems, in particular for separating solids from produced fluids in a wellbore, which may be used in conjunction with gas separators.

BACKGROUND OF THE INVENTION

In the current state of the art, pumping wellbore fluids has the propensity to produce large pockets of gas, over twenty foot (20') columns, and thereby gas-locking a pump, preventing production. Solids, such as sand, may also be produced at the same time, additionally limiting the efficiency of the pump, or worse. There is a strong need to separate gas and solids from production fluids in the wellbore so that pumping efficiency of valuable liquids is not inhibited.

There is a strong need to separate solids from production fluids in the wellbore so that only liquids are pumped, thus preventing locking of the well and providing more liquid returns from the pump. The inventor has recognized that a separate downhole solids removal apparatus and/or system will greatly improve the operation of down hole gas separators.

DETAILED DESCRIPTION OF THE INVENTION

Disclosed herein are descriptions of various examples of the invention.

Figure 1:
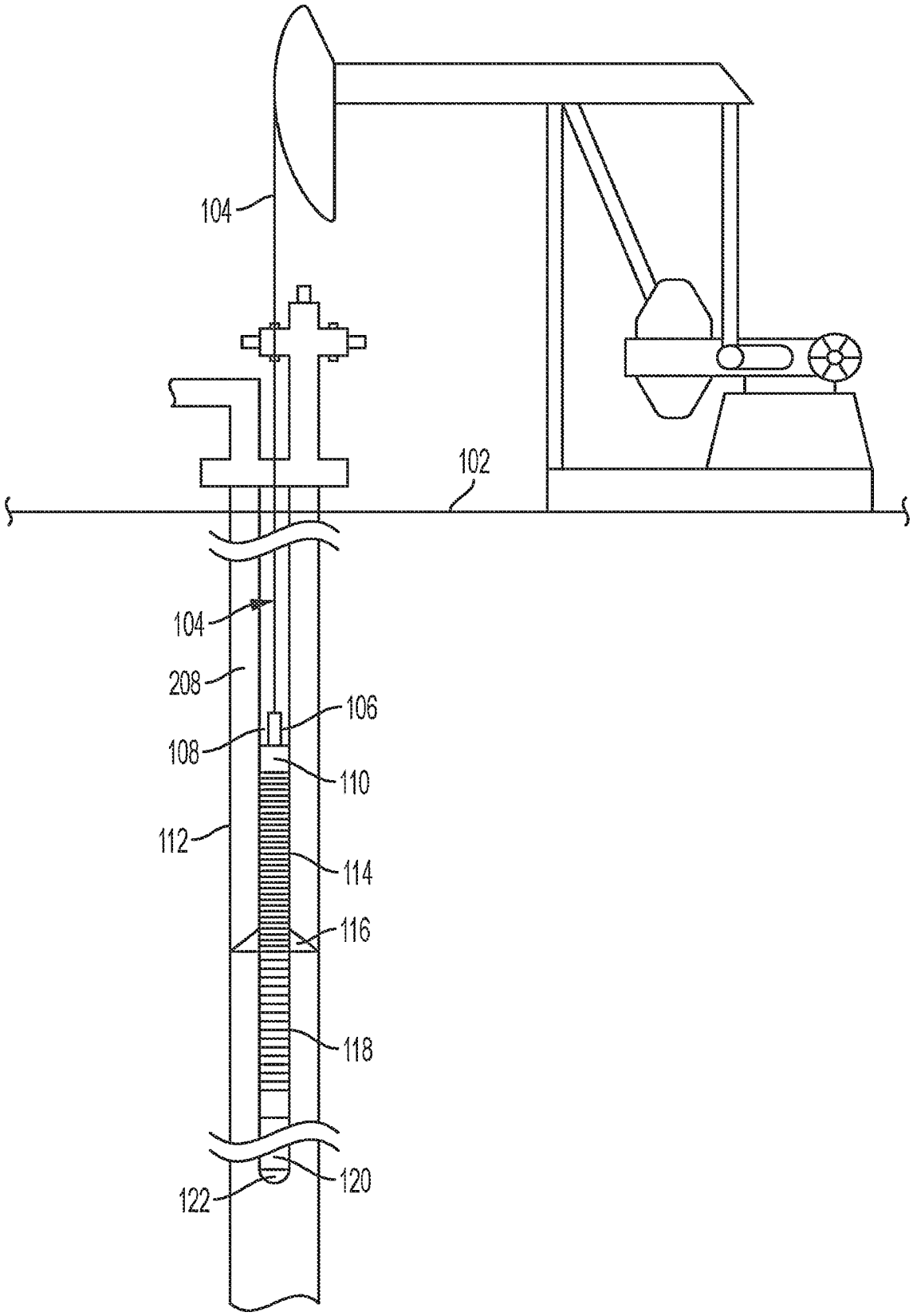
FIG. 1 illustrates a schematic frontal diagram of a producing pumping well that has a string of gas separators and the present stack of solids separators of the present invention deployed in the well.

FIG. 1 illustrates a schematic frontal diagram of a producing pumping well that has a string of gas separators and the present solids separator deployed in the well.

The tops sides pump jack (not numbered) is placed at or above ground or earth surface 102, above a cased wellbore 112. A production tubing string 108 is connected to the topsides at or around surface 102 and runs into the well bore 112.

The top sides pump jack holds and controls a pump rod string 104 that holds and controls a pump 106 that is deployed inside production tubing string 108. In one example, pump rod string 104 is not present, such as on an electric submersible positive cavity pump (ESP).

Well bore casing 112 and production tubing string 108 forms a well bore annulus 208.

Production tubing string 108 holds a production string assembly of several components (106, 110, 114, 118, 120, 122), as illustrated. In one example, pump 106 is connected to the assembly of components by way of a pump seat nipple 110.

The production string assembly (106, 110, 114, 118, 120, 122) includes: a production tubing string 108 that runs to the surface equipment. Held by a pump rod string 104, pump 106 is connected to a pump seat nipple 110 which connects to a stack 114 of down hole gas separators. Underneath the stack 114 of downhole gas separators is solids separator 118 of the present invention. Underneath solids separator stack 118 are mud joints 120 and, in one example, terminating in a bull plug 122, forming the bottom of the production tubing string.

In one example, the stack 114 of downhole gas separators is a multistage predator-style gas separator system.

In one example, the stack 118 of solids separators is called a multi-stage sand/solids separator system.

A packer 116 is disposed in the well bore annulus 208, for example a well bore CP packer cup. Packer 116 isolates well bore annulus 208 such that gas separator and intake of fluids (and fluids containing solids) is below the packer 116.

In one example, the solids-laden fluids are drawn into each of the parallel-operating solids separators of the stack 118 multi-stage sand/solids separator system. These are disposed below the packer 116. As will be more fully described and shown herein, the solids are eventually deposited into mud joints 120 and bull plug 122. The sand/solids are pulled into this closed system as all fluids are forced into the stack 118 of sand separators, with sand/solids being pulled down while fluids are being pulled back into the well bore and, in one example, into the gas separators.

Figure 2:
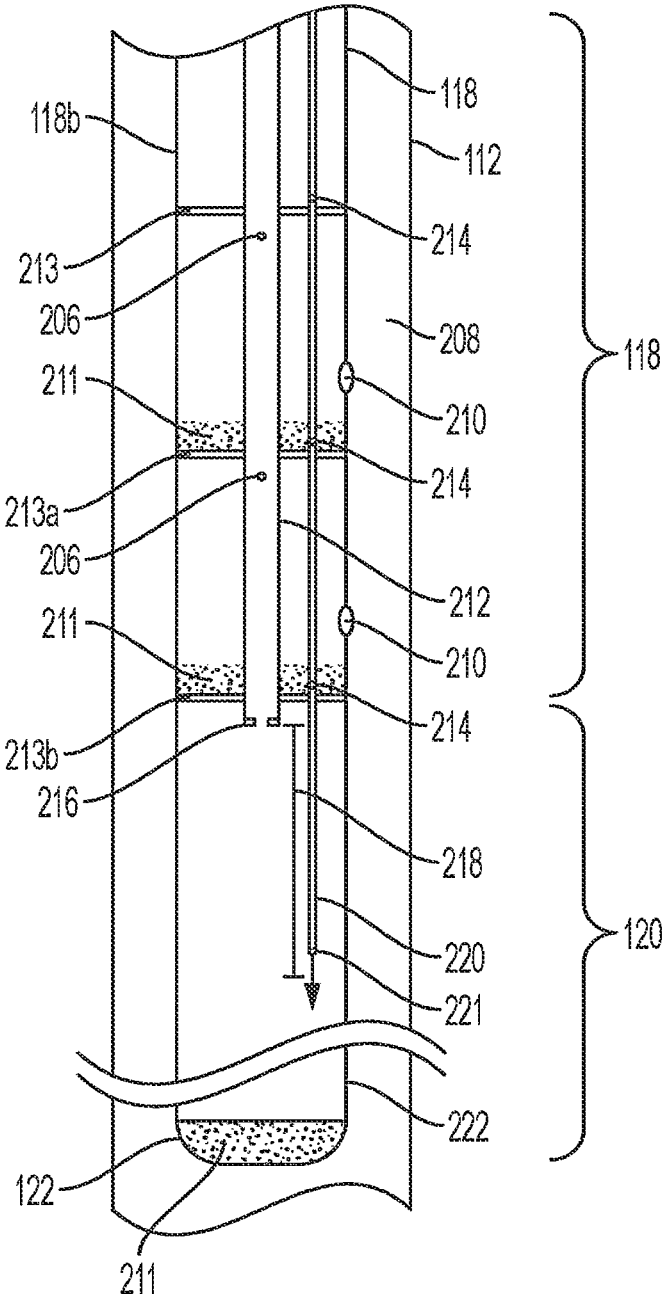
FIG. 2 illustrates a schematic frontal diagram of a few of the stacked solids separators of the present invention that are attached to the production string that is deployed in a well, operating in parallel, followed by mud joints and bull plug.

FIG. 2 illustrates a schematic frontal diagram of a few of the stacked solids separators of the present invention that are attached to the production string that is deployed in a well, operating in parallel, followed by mud joints and bull plug.

Sections 118 and 120 of the production string are deposed inside the wellbore casing 112, forming wellbore annulus 208. In one example, multiple solids separators operate independently in parallel to draw in fluids, forming stack 118. In one example, these solids separators are separated from each other by gaskets 213. As shown in FIG. 1, in one example, there is a packer sub 116 that seals off the well bore (well bore annulus 208) such that fluids are forced into the tool through holes 210 that are placed in the wall of outer pipe **118*b* of the production string of stack 118. Each of holes 210 provides an entry way into each respective solids separator module. In one example, this enables the solids separators to work on continuous flow. In one example, holes 210 are placed in the lower half of each solids separator module. In one example, holes 210 are restricted openings. In one example, holes 210 are also called thief jets or well entry ports. A dip tube 212 is located inside the stack 118. Dip tube 212 is a production tube that draws or otherwise receives the final, processed fluids that will be brought to the surface 102 for recovery of energy bearing hydrocarbons (or desired fluids, such as water for a water well). In one example, dip tube 212 passes into mud joints 120 and has an orifice opening at the end of the tube 212**.

In one example, gaskets 213 isolate each of the solids separator modules of stack 118. For example, gasket 213*a* forms the top one separator module and gasket 213*b* forms the bottom of that separator module.

In one example, ports 206 are placed in each of the solids separators to draw fluids in from the separator. In one example, ports 206 are placed in the dip tube 212 at a location in the upper half of the solids separator module. In one example, ports 206 are placed at a location that is at or near the top of the solids separator module. In one example, dip tube 212 goes through gas separators 114 so the fluids entering the dip tube 212 from the solids separators are brought up, above packer 116, and expelled from the gas separators 114 into the well bore annulus 208 (above the packer 116) as part of the gas separating process. Thus, in one example, the fluids go right back into the wellbore. Thus, since the packer is above the entry ports 210 of the solids separator tool stack 118, everything (all the fluids being produced) must go through the solids separators modules, stack 118.

In one example, the flow of fluids is continuous flow, all the way through the sand separator modules, tool stack 118. As the fluids and solids (such as sand) come through the intake port(s) 210, the solids will accumulate towards the bottom of each solids separator module, and fluids will be pulled from the module through ports 206 and into the dip tube 212.

In one example, there is a tube 220 that runs through the solids separator modules and into the mud joints 120, which we can call a trash chute 220. In one example, other configurations of tubes and openings can be used to achieve the same function. One end of trash chute 220 terminates into mud joints 120 with an open end 221. Holes or ports 214 are disposed in trash chute 220 towards the bottom of each solids separator module. As solids 211 accumulate at or near the bottom of each solids separator module, these holes or ports 214 allow the solids 211 to be drawn in to trash chute 220 and expel through bottom end opening 221, so that the solids 211 dump into the volume enclosed by the mud joints 120 and the solids accumulate into bull plug 122.

In one example, a restricted opening 216, which can be called a fluid entry port or choke back port, is at the bottom opening of dip tube 212. At the bottom of dip tube 212, which penetrates into mud joints 120, the opening 216 is inside the closed system of the mud joints 120. To draw fluids from the inside enclosure of mud joints 120 causes drawing from opening 221 of trash chute 220. In one example, the only way to get replenishment is through opening 221.

In one example, as the draw from pump 106 can be adjusted, fluids will be pulled from mud joints stack 120 through restricted opening 216 of dip tube 212. In one example, restricted opening 216 is called a thief jet. Since holes or ports 214 of trash chute 220 are the source of supply for trash chute 220, solids 211 in each of the solids separator modules of stack 118 will be drawn into trash chute 220 and fall into mud joints 120, to accumulate at the bottom, for example, in the bottom bull plus 122.

In a surprising result, the distance between the bottom of trash chute 220 (the bottom opening 221) and the restricted opening 216 of dip tube 212 creates what inventor calls a "kill zone". Fluid is demanded from restricted opening 216 of dip tube 212, based on the demand from pump 106. Yet, there is only a limited amount of fluid in the mud joints 120. Thus, the amount of fluid that enters through restricted opening 216 of dip tube 212 is less than the amount of fluid that would be sufficient to create an upward fluid velocity sufficient to levitate the solids out of the mud joints 120 through restricted opening 216 of dip tube 212. The fluid velocity is "killed". In one example, the port of restricted opening 216 is narrowed to effect this velocity "kill". Arrow 218 illustrates the length of trash chute 220 between restricted opening 216 and bottom opening 221 of trash chute 220 that is engineered with the amount of restriction of opening 216 to effect the "kill zone" in limiting the upward fluid velocity. Thus, the solids (sand, for example) are pulled down out of the bottom of each solids separator module for deposit into the bottom chamber formed by the mud joints 120 and bull plug 122.

In one example, gases, liquid, and solids go into the tool through the ports 210, the sand falls due to natural gravitational force and the gases and fluid rise and flow into the annulus of the tool, to go up and out. With each pump stroke the port will suck out sand through the tube 220 out of the opening 221, and the solids free gas and fluids go into the wellbore going up.

In one example, the velocity in the bottom cylinder is not fast enough to suck the solids back up.

In one example, zone 218 is approximately five feet (5') long and limited entry port 216 is one-quarter inch (¼"). In one example, zone 218 is approximately six feet (6') long. In one example, zone 218 is approximately seven feet (7') long.

In one example, the solids separation system capitalizes on use of the cross-sectional area. In one example, the tool is much longer, the separator stack 118 ranging in length from thirty feet (30') to ninety feet (90') in length. In one example, the separator stack 118 is approximately thirty feet (30') in length. In one example, the separator stack 118 is approximately sixty feet (60') in length. In one example, the separator stack 118 is approximately ninety feet (90') in length.

In one example, the system includes a packer placed in the annulus of the wellbore and a dip tube that leads into the wellbore. The system is arranged and configured to create a continuous flow for fluids going through the solids separators from below the packer and then back into the wellbore, above the packer.

In one example, the dip tube feeds upward into a gas separator or gas separator system. In one example, the gas separator system is as previously disclosed by Gary Marshall in U.S. Pat. No. 10,907,462 and related patent applications. In one example, the size, position and arrangement of the restricted opening 216 of the dip tube, and opening 221 of the trash chute are engineered to cooperate with the gas separator or gas separator system. In one example, the gas separator system is a stack of separator modules. The separator modules draw the fluid to be processed in parallel, adding to the total cross-sectional area of the draw at different vertical heights.

In one example, the zone of solids 211 in each solids separator module is about three inches (3"). In one example, the orifice 214 of chute 220 is placed within the zone of solids 211. In one example, this zone of solids is called the "cellar".

In one example, each solids separator module is twelve inches (12") in height.

In one example, the restricted opening 216 is placed two inches (2") below the top of the mud joints 120, for example, two inches (2") from gasket 213*b*.

In one example, entry ports 210 of the solids separator tool stack 118 are a one-half inch by two inch long slot (½" by 2").

Figure 3:
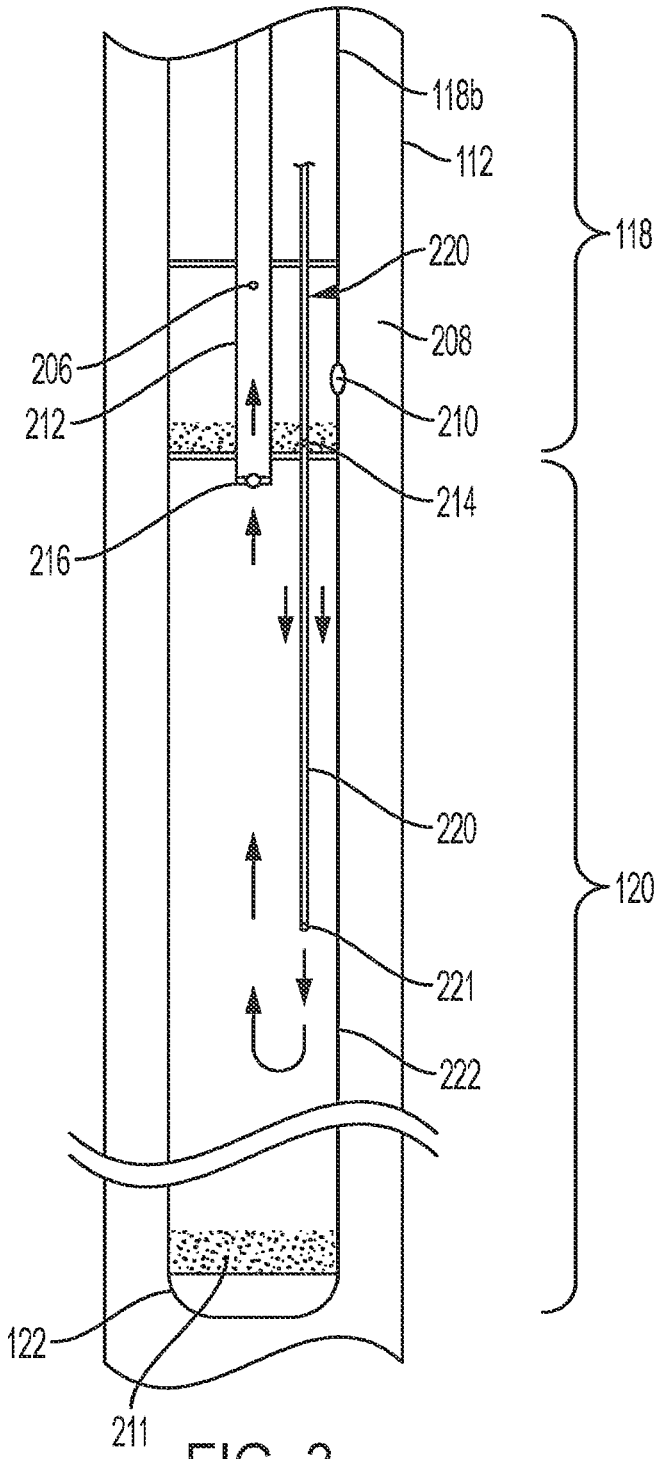
FIG. 3 illustrates a schematic frontal diagram of the present solids separator attached to the production string that is deployed in a well, showing with arrows the flow of solids and fluids in the system.

FIG. 3 illustrates a schematic frontal diagram of the present solids separator attached to the production string that is deployed in a well, showing with arrows the flow of solids and fluids in the system.

To better illustrate the dynamics of the solids separation system, solids-laden fluid enters the tool below the packer from the wellbore annulus 208, in through openings 210. These solids-laden fluids enter into each of the solids separator modules. Fluids are drawn from the solids-laden fluids that are inside the solids separator modules by holes 206 that are in the production dip tube 212, near the top of the solids separator module. Solids-laden fluids remaining, more concentrated in solids 111, are drawn into hole 214 in trash chute tube 220. The solids are drawn down trash chute tube 220, as indicated by the parallel arrows along trash chute tube 220 inside mud joints 120. A hole opening at the bottom of trash chute 220 dumps the heavily solid-laden fluid into the mud joints 120. A limited velocity draw is accomplished by restricted opening 216 into the bottom of the production dip tube 212, placed near the top of the mud joints 120. Fluid flows upward and into the dip tube 212, but at a lower velocity that is insufficient to elevate the solids. In one example, the fluids now in the production dip tube are sent above the packer 116. In one example, one or more gas separators are above the packer 116 and dump the fluids back into the well bore annulus 208 (above the packer) for gas separation processing by the gas separator or cascade or stack of gas separators. In one example, a series of Marshall-type gas separators running in parallel are used, as more fully described in U.S. Pat. No. 10,907,462 and related patent applications. In one example, the sand separator of the present disclosure is positioned and arranged to work in cooperation with Marshall-type gas separators. In one example, the opening sizes and lengths of the sand separator of the present disclosure is engineered to be adapted to work in cooperation with Marshall-type gas separators.

As can be appreciated, in the closed system of the solids separators stack 118 and the mud joints 120, all the fluids are going up. The only downward flow is in the trash chute tube 220 coming from the bottom of each solids separator module, from the trash chute intake ports 214. In the closed loop solids retrieval system, the velocity is slowed down for the sand/solids to fall to the bottom because of gravity, and only the solids-free fluid will travel back into the wellbore at the top of the sand separator 118, above the packer sub 116.

In one example, the solids separator modules are stacked in multiples for ease in deployment in the field. In one example, the solids separator modules form a stack in multiples. In one example, the solids separator stack includes ten (10) solids separator modules. In one example, the solids separator stack includes twenty (20) solids separator modules. In one example, the solids separator stack includes thirty (30) solids separator modules. In one example, the solids separator stack includes fifty (50) solids separator modules.

In one example, wellbore intake holes 210 of the solids separator tool stack 118 are thief jets. In one example, wellbore intake holes 210 of the solids separator tool stack 118 are thief jets ranging in opening size of from 1/16" to V4", these are in the top of each sand separator module. In one example, wellbore intake holes 210 of the solids separator tool stack 118 are thief jets, placed in multiples.

In a particular, preferred example of the solids separation system: the dip tube is ⅝";

the trash chute is ½", while the wellbore casing is 7";

the mudjoints are 3½" outside diameter with an inside diameter of 3";

with a ⅝" dip tube placed inside and a ½" trash chute placed inside the production string;

with the mud joints stack, including the bull plug, being ten feet 10' long;

with the restricted entry port at the end of the dip tube and placed in the mud joints stack being ¼" opening with a fluid velocity kill zone being five feet length (approximate distance from restricted entry port at the end of the dip tube to the bottom opening of the trash chute); and with the solids separator modules being twelve inches (12") in length each.

In one example, the dip tube is ⅝".

In one example, the trash chute is ½".

In one example, the wellbore casing is 7".

In one example, the mud joints are 3½", thus an outside diameter of 3½" and in inside diameter of 3" with a ⅝" dip tube placed inside and a ½" trash chute placed inside.

In one example, the mud joints stack 120, including the bull plug 122, is ten feet 10' long.

In one example, the restricted entry port 216 is ¼" with a fluid velocity kill zone 218 of five feet (5').

In one example, the solids separator module is twelve inches (12").

In one example, herein disclosed is a downhole solids separator, the separator including:

a plurality of solids separation modules (118), a production tube (212) disposed in the solids separation modules (118), one or more limited entry ports (206) in the production tube (212), the limited entry port placed in each of the plurality of solids separation modules (118), an intake port (210) disposed in the lower half of each solids separation module opening into a wellbore annulus (208), the intake port (210) disposed below the location of the limited entry port (206) of the corresponding module, a closed chamber (120) for collecting solids, isolated from the well bore, the closed chamber disposed below the lower most solids separation cylinder, a conduit (220) positioned and arranged for the conveying of solid materials, the conduit disposed through each solids separation module, the conduit having a lower end disposed in the closed chamber (120), an opening (214) in the conduit in each of the solids separation modules, the opening disposed near the bottom of the corresponding solids separation module, a delivery opening (221) disposed at the lower end of the conduit (220), opening into the closed chamber (120), an opening (216) in the production tube (212), the opening (216) disposed in the closed chamber (120), wherein the opening (216) in the production tube (212) is restricted to less than the size of the production tube, and wherein opening (216) and delivery opening (221) are sized, positioned and arranged to effect a drop fluid velocity into production tube (212) to a level insufficient to carry solids into the production tube (212).

In a further example, additionally, entry ports (210) are disposed below a packer (116) that closes the wellbore annulus (208) and production tube (212) delivers the fluids drawn from opening (216) to a location above packer (116).

In a further example, the fluids drawn from opening (216) are expelled into the wellbore annulus (208) at a location above packer (116).

Figure 4:
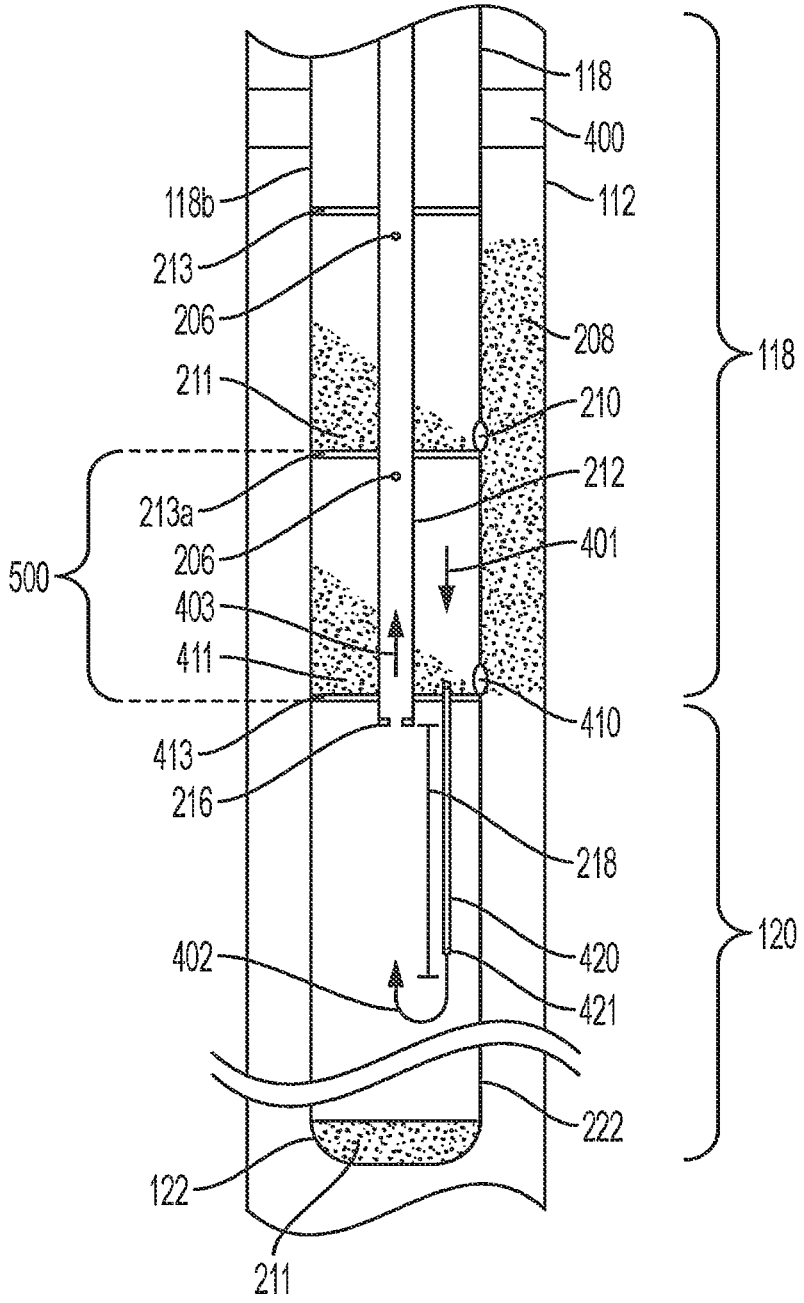
FIG. 4 illustrates a schematic frontal diagram of a few of the stacked solids separators of the present invention with modified trash chute and modified intake ports, that are attached to the production string that is deployed in a well, operating in parallel, followed by mud joints and bull plug.
Figure 5:
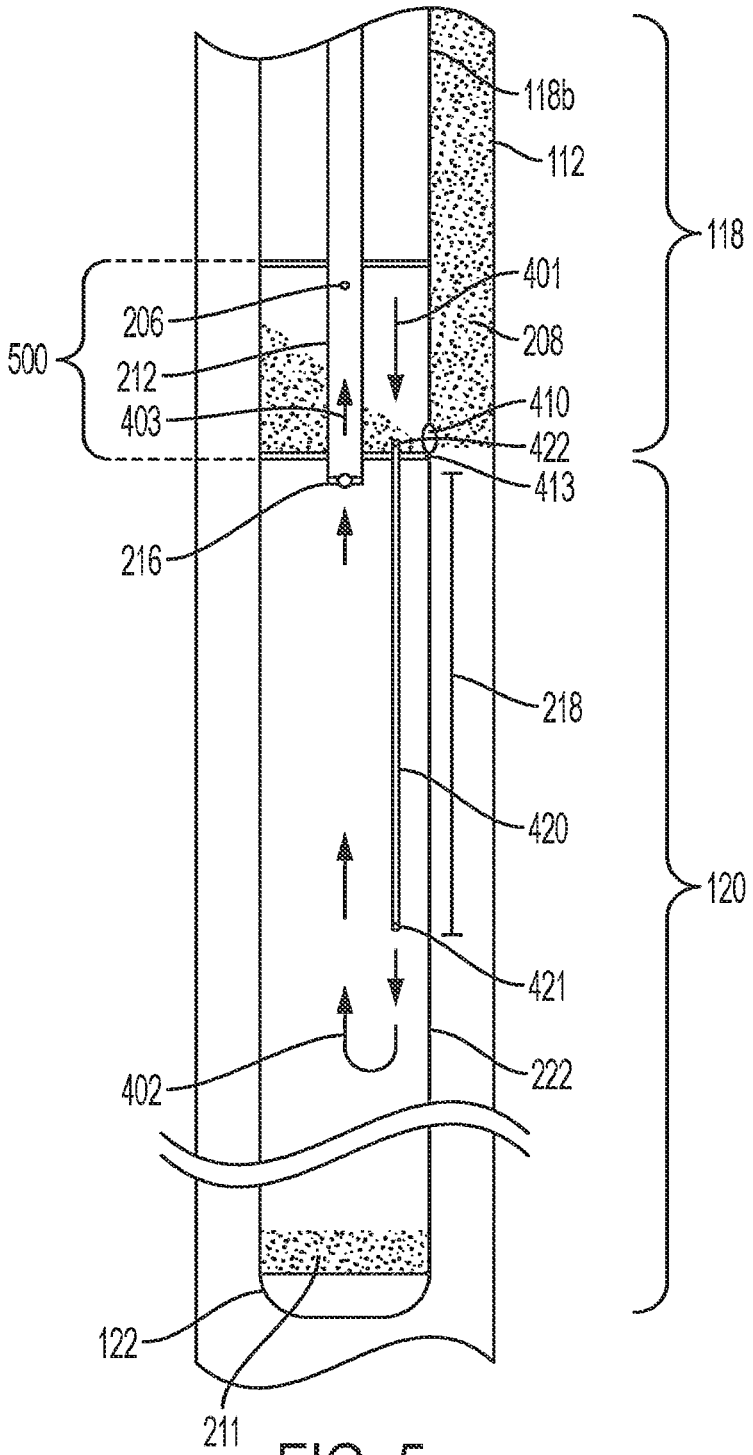
FIG. 5 illustrates a schematic frontal diagram of the present solids separator with modified trash chute and modified intake ports, attached to the production string that is deployed in a well, showing with arrows the flow of solids and fluids in the system.

FIG. 4 illustrates a schematic frontal diagram of a few of the stacked solids separators of the present invention with modified trash chute and modified intake ports, that are attached to the production string that is deployed in a well, operating in parallel, followed by mud joints and bull plug. FIG. 5 illustrates a schematic frontal diagram of the present solids separator with modified trash chute and modified intake ports, attached to the production string that is deployed in a well, showing with arrows the flow of solids and fluids in the system.

In one example, the trash chute is absent in the solids separator modules, except the bottommost module 500. In bottommost module 500, one end (422, FIG. 5) of the trash chute tube 420 opens near the bottom of module 500 and progresses downward into mud joints stack 120. The length of the trash chute tube 420 in the mud joints stack 120 defines or is otherwise associated with the kill zone as indicated by bar 218. In one example, intake port 410 is located toward or at the bottom of bottommost separator module 500. In one example, intake ports 210 in the other solids separator modules of stack 118 are also disposed toward or at the bottom of each solids separator module.

In this configuration, intake ports 210 and 410 serve to also dump solids back into wellbore annulus 208. This is illustrated by the triangular shape of accumulated sands or solids 211 and 411 in each of the solids separator modules. The inventor has recognized that the fluid column in the annular region 208 around the tool in the wellbore can only hold a certain amount of sand (solids) and that higher concentrations are recognized in the lower portion of the demand fluid column. Hence, in this example, a modified positioning, size, and arrangement of the intake ports 210 and 410 as well as placement of the trash chute 420 in the bottommost solids separator module 500, eliminating the trash chute in upper solids separator modules.

Thus, solids-laden fluid flow in bottommost solids separator 500 is downward into trash chute 420 at top opening 422, as indicated by flow arrow 401. As indicated by flow arrow 402, the fluids exit the trash chute 420 at bottom opening 421 into mud joints 120 and proceed to flow upward toward restricted orifice 216 that opens into the bottom of production dip tube 212. As indicated by flow arrow 403, fluids then flow upward in the production did tube 212 as drawn by the pump. Each solids separator module has an orifice 206 in the production dip tube 212, near the top of each module. Each office 206 in the solids separator modules enables solids-depleted fluids to be drawn from each solids separator module and into the production dip tube 212.

In one example, bottommost solids separator module 500 (the bottom cylinder) is one foot in height. In one example, restricted orifice 216 that opens into the bottom of production dip tube 212 is a ¼ inch opening. In one example, the fluid velocity kill zone 218, representing the effective length of trash chute 420, is five feet.

In one example, gaskets 213*a* and 413 of bottommost solids separator module 500 (the bottom cylinder) is a sandwiched construction of a metal plate, gasket, gasket, and metal plate. Thus, two gaskets are sandwiched between a top metal plate and a bottom metal plate, creating barrier or what is illustrated as gasket 413.

In one example, a perforated cup sub is used for packer 116. In one example, a non-perforated cup sub is used for packer 116. In one example, fluids drawn through production dip tube 212 go directly to a pump. In one example, fluids drawn through production dip tube 212 go through gas separators. In one example, the gas separators used are as previously disclosed by Gary Marshall in U.S. Pat. No. 10,907,462 and related patent applications and the solids separators are engineered to operate cooperatively with these type of separators.

In one example, the sizes of the orifices 206 in the production dip tube 212 are varied from solids separator module to module. In one example, the orifices 206 are made larger going down to lower solids separator modules in the stack 118.

CONCLUSION

Although the present invention is described herein with reference to a specific preferred embodiment(s), many modifications and variations therein will readily occur to those with ordinary skill in the art. Accordingly, all such variations and modifications are included within the intended scope of the present invention as defined by the reference numerals used.

From the description contained herein, the features of any of the examples, especially as set forth in the claims, can be combined with each other in any meaningful manner to form further examples and/or embodiments.

The foregoing description is presented for purposes of illustration and description, and is not intended to limit the invention to the forms disclosed herein. Consequently, variations and modifications commensurate with the above teachings and the teaching of the relevant art are within the spirit of the invention. Such variations will readily suggest themselves to those skilled in the relevant structural or mechanical art. Further, the embodiments described are also intended to enable others skilled in the art to utilize the invention and such or other embodiments and with various modifications required by the particular applications or uses of the invention.

I claim:

1. A down-hole solids-separation apparatus, configured for installation in a production string within a wellbore, comprising:

an outer tubular body defining a separator chamber;

an upper annular gasket and a lower annular gasket axially spaced on the outer tubular body to isolate the separator chamber from adjacent portions of the production string;

at least one well-entry port passing through the outer tubular body at a location below the upper annular gasket and above the lower annular gasket, the well-entry port being sized to admit well fluids laden with particulate solids into the separator chamber;

a dip tube extending axially through the separator chamber and beyond the lower annular gasket into a collection region, the dip tube including a restricted opening positioned within the collection region; and a restricted fluid-entry port provided in the dip tube and positioned in the separator chamber at an upper portion of the separator chamber;

wherein, during operation:

solids carried by fluids entering through the well-entry port settle by gravity in a lower portion of the separator chamber, flow into the collection region via a solids-conveying conduit, and collect below the restricted opening; and solids-depleted fluid is drawn into the dip tube through the restricted opening in the collection region and through the restricted fluid-entry port in the separator chamber for production to surface, thereby reducing re-entrainment of settled solids.

2. The apparatus of claim 1, wherein the restricted opening is smaller in flow area than an internal bore of the dip tube.

3. The apparatus of claim 2, further comprising a delivery opening terminating in the collection region below the lower annular gasket.

4. The apparatus of claim 3, wherein the solids-conveying conduit is configured to transfer the settled solids from the separator chamber to the collection region for permanent deposition.

5. The apparatus of claim 1, wherein the solids-conveying conduit has an intake opening located adjacent a bottom portion of the separator chamber.

6. The apparatus of claim 1, wherein a second well-entry port is formed through the outer tubular body at a vertical position intersecting a line that defines a kill-zone length, thereby enabling additional fluid intake into the collection region below the separator chamber.

7. The apparatus of claim 1, further comprising multiple separator chambers positioned in a stack, wherein a plurality of restricted fluid-entry ports are provided in the dip tube each positioned in an upper portion of a respective separator chamber of the multiple separator chambers, and wherein a flow area of each of the plurality of restricted fluid-entry ports increases progressively in a downward direction along the dip tube to balance flow across the multiple separator chambers.

8. The apparatus of claim 1, wherein an axial distance between the restricted opening and a delivery opening of a solids-conveying conduit defines a kill-zone having a length of at least five feet (1.5 m) so that an upward velocity of fluid entering the dip tube through the restricted opening is insufficient to lift solids from the collection region.

* * * * *